US006200006B1

(12) United States Patent
Natsume et al.

(10) Patent No.: US 6,200,006 B1
(45) Date of Patent: Mar. 13, 2001

(54) VEHICLE LAMP

(75) Inventors: Kazunori Natsume; Mitsuru Kubota, both of Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/369,422

(22) Filed: Aug. 6, 1999

(30) Foreign Application Priority Data

Aug. 7, 1998 (JP) ..... 10-223976

(51) Int. Cl.[7] ..... F21V 7/00

(52) U.S. Cl. ..... 362/297; 362/348; 362/517; 362/518; 362/346; 362/305; 362/499

(58) Field of Search ..... 362/296, 297, 362/517, 518, 499, 346, 347, 348, 304

(56) References Cited

U.S. PATENT DOCUMENTS 5,034,867 * 7/1991 Mayer ..... 362/297
5,707,141 * 1/1998 Yamamoto et al. ..... 362/305
5,836,668 * 11/1998 Ishkawa et al. ..... 362/61

* cited by examiner

*Primary Examiner*—Sandra O'Shea
*Assistant Examiner*—Ali Alavi
(74) *Attorney, Agent, or Firm*—Sughrue, Mion, Zinn, Macpeak & Seas, PLLC

(57) ABSTRACT

Diffusing reflector elements 14*s* are assigned respectively to a plurality of sector segments S centering on the optical axis Ax of reflector 14; the surface geometry of each diffusing reflector element 14*s* is set as a convex curved surface referenced to a paraboloid of revolution P which, among a plurality of paraboloids of revolution P having different focal lengths that center on the optical axis Ax with a common focus F lying at a single point on the optical axis, passes the edge of a side a closer to the optical axis of the sector segment S to which said diffusing reflector element 14*s* is to be assigned on a free curved surface Cf. As a result, the diffusing reflected light from each diffusing reflector element 14*s* can be controlled in diffusion with reference to the direction of the optical axis Ax and, in addition, when the lighting device is lit up and viewed right from the front, the entire part of the reflective surface 14*a* is visible and can be seen bright although in a discrete manner. Further, no shade is formed between circumferentially adjacent diffusing reflector elements 14*s*, thus assuring the lighting device to look sufficiently attractive. element.

8 Claims, 8 Drawing Sheets

VEHICLE LAMP

BACKGROUND OF THE INVENTION

This invention relates to a vehicle lamp, more particularly, to the construction of the reflective surface of its reflect component.

A typical modern type of vehicle lamps is shown in FIG. 7; the reflective surface 114*a* of the reflector 114 is composed of a plurality of diffusing reflector elements 114*s* and used in combination with a glass 116 having little or no refractive power to provide the light with a feeling of transparency or greater depth.

As is clear from FIG. 7, the plurality of diffusing reflector elements 114*s* are formed with reference to a single paraboloid of revolution P', so the increase in the diameter of the opening of the reflector 114 results in a corresponding increase in its depth dimension. If the vehicular structure and other design considerations limit the space for installing the identification lamp, the diameter of the opening of the reflector 114 has to be reduced but then the light emitting surface is reduced accordingly to make the lighting device look less attractive.

An improvement over this light is shown in FIG. 8; a reflective surface 214 is composed of a plurality of diffusing reflector elements 214*s* formed on a free curved surface Cf'. This increases the degree of freedom in the shape of the reflector 214 and even if only a limited space is available for installing the identification lamp, the reflective surface of the reflector 214 can be composed while ensuring a sufficient diameter for its opening.

However, the mere formation of diffusing reflector elements 214*s* on the free curved surface Cf to compose the reflective surface 214*a* causes the following problems. To assure the intended luminous intensity distribution from a vehicle lamp, diffusing light must be created in all directions from the optical axis Ax' of the reflector 214. If a plurality of diffusing reflector elements 214*s* are simply formed on the free curved surface Cf', the direction of the diffusing reflected light from each element varies randomly with the shape of the free curved surface Cf'; as a result, the directivity of the illuminating light from various parts of the reflective surface 214*a* cannot be sufficiently controlled to ensure the intended luminous intensity distribution for the lighting device. Further, depending on the position of individual diffusing reflector elements 214*s* on the free curved surface Cf', there will be no reflected light that travels from certain elements toward the optical axis Ax' and those elements are invisible if they are viewed right from the front of the lighting device being lit up. This makes the lighting device look less attractive.

SUMMARY OF THE INVENTION

The present invention has been accomplished under these circumstances and has as an object providing a vehicle lamp which has its reflector component composed of a plurality of diffusing reflector elements formed on a free curved surface and which is characterized by ease in assuring the intended luminous intensity distribution and by the ability to prevent the light from looking less attractive when it is lit up.

This object of the invention can be attained by setting a plurality of sector segments about the optical axis of a reflector for assignment of diffusing reflector elements, setting specified paraboloids of revolution in accordance with the positions of the respective sector segments, and setting the surface geometries of the individual diffusing reflector elements with reference to the respective paraboloids of revolution.

The present invention provides a vehicle lamp comprising a light source and a reflector that allows the light from the light source to be reflected in a forward direction and the reflective surface of which is composed of a plurality of diffusing reflector elements formed on a free curved surface, characterized in that the individual diffusing reflector elements are respectively assigned to a plurality of sector segments centering on the optical axis of said reflector and that the surface geometry of each of said diffusing reflector elements is set on a specified curved surface that is referenced to a paraboloid of revolution which, among a plurality of paraboloids of revolution having different focal lengths that center on said optical axis with a common focus lying at a single point on said optical axis, passes a specified point of a sector segment to which said diffusing reflector element is to be assigned on said free curved surface.

The term "free curved surface" as used hereinabove means any curved surface other than a quadratic curved surface.

The "sector segments" may be set on equal pitches in both a radial and a circumferential direction as long as they center on the optical axis of the reflector; alternatively, they may be set on varying pitches in either a radial or a circumferential direction or in both directions.

The "specified point" may be the center or an end point of each sector segment or it may be any other point of the sector segment.

The "specified curved surface" is not limited to any particular curved surface as long as it is formed as a curved surface (which may be a plane) referenced to a paraboloid of revolution and if it has diffusing and reflecting capabilities.

In this invention, the reflective surface of the reflector in the vehicle lamp of the invention is composed of a plurality of diffusing reflector elements formed on a free curved surface. This increases the degree of freedom of the reflector's shape and even if only a limited space is available for installing the identification lamp, the reflective surface of the reflector can be composed while ensuring a sufficient diameter for its opening.

Given this basic design, the individual diffusing reflector elements are respectively assigned to a plurality of sector segments centering on the optical axis of the reflector and the surface geometry of each of the respective diffusing reflector elements is set on a specified curved surface that is referenced to a paraboloid of revolution which, among a plurality of paraboloids of revolution having different focal lengths that center on said optical axis with a common focus lying at a single point on said optical axis, passes a specified point of a sector segment to which said diffusing reflector element is to be assigned on said free curved surface. As a result, the diffusing reflected light from each diffusing reflector element can be controlled in diffusion with reference to the axial direction of the reflector and the directivity of the diffusing illumination from the reflective surface taken as a whole can be easily controlled. In addition, when the lighting device is lit up and viewed right from the front, the entire part of its reflective surface is visible and can be seen bright although in a discrete manner.

Thus, according to the present invention, there is provided a vehicle lamp in which the reflective surface of the reflector is composed of a plurality of diffusing reflector elements formed on a free curved surface and which is characterized by ease in assuring the intended luminous intensity distribution for the lighting device while preventing it from looking less attractive when it is lit up.

The invention is also characterized in that the individual diffusing reflector elements are respectively assigned to the plurality of sector segments centering on the optical axis of the reflector and this offers the following advantage in the way the lighting device looks externally when it is lit up.

If the construction of the present invention is adopted, a plurality of diffusing reflector elements are formed stepwise on a free curved surface and a difference in level occurs between adjacent diffusing reflector elements. Depending on the orientation of such level differences, shades will be cast on the reflective surface against the light from the light source in the lighting device being lit up. If such shades are shaped randomly, the lighting device being lit up and viewed externally will look less attractive, particularly in the case where the lens has no refractive power.

In fact, however, the individual diffusing reflector elements are assigned respectively to the plurality of sector segments centering on the optical axis of the reflector and, hence, no shades will be cast between circumferentially adjacent diffusing reflector elements but shades are only cast between radially adjacent diffusing reflector elements. The shades thus cast are generally shaped like arcuate bands centering on the optical axis; in other words, the shades have a certain order of formation and can prevent the lighting device from looking less attractive or even helping it look more attractive.

If the radial widths of the individual sector segments are so set that they increase or decrease as they depart from the optical axis, the theory of linear perspective helps provide the reflector with either a greater feeling of depth than its actual depth dimension or a three-dimensional feel different from that of ordinary reflectors.

If the focal lengths of the paraboloids of revolution that serve as reference planes for the individual diffusing reflector elements are set to have greater values for the diffusing reflector elements assigned to sector segments that are increasingly distant from the optical axis, the thickness of the reflector can be sufficiently reduced.

In this case, a step that sharply descends in direction away from the optical axis occurs between radially adjacent diffusing reflector elements and the area that casts a shade due to the step becomes a non-reflective area in a diffusing reflector element that is adjacent in a direction away from the optical axis. If each diffusing reflector element is assigned to an area more remote from the optical axis than a curve along which a straight line passing through the edge of a side away from the optical axis of a diffusing reflector element that is adjacent toward the optical axis and the light source intersects the reference plane for that diffusing reflector element, the desired diffusing and reflecting angles can be assured for the individual diffusing reflector elements, whereby the intended luminous intensity distribution can be positively provided for the lighting device.

DETAILED DESCRIPTION OF INVENTION

Figure 1:
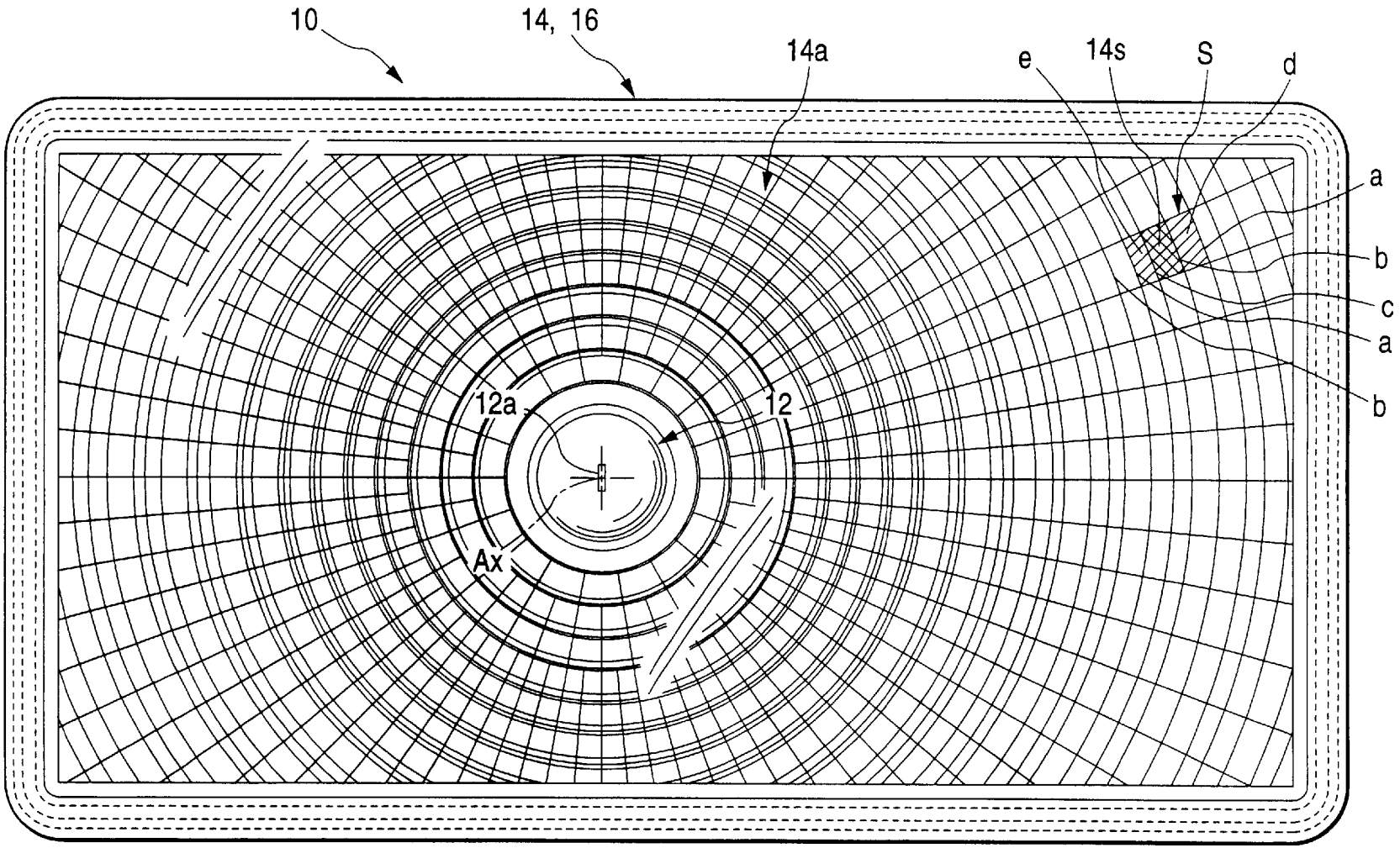
FIG. 1 shows a front view of a vehicle lamp according to an embodiment of the invention.

We now describe an embodiment of the present invention with reference to accompanying drawings. FIG. 1 is a front view of a vehicle lamp according to an embodiment of the invention and FIG. 2 is a transverse section of the light.

Figure 2:
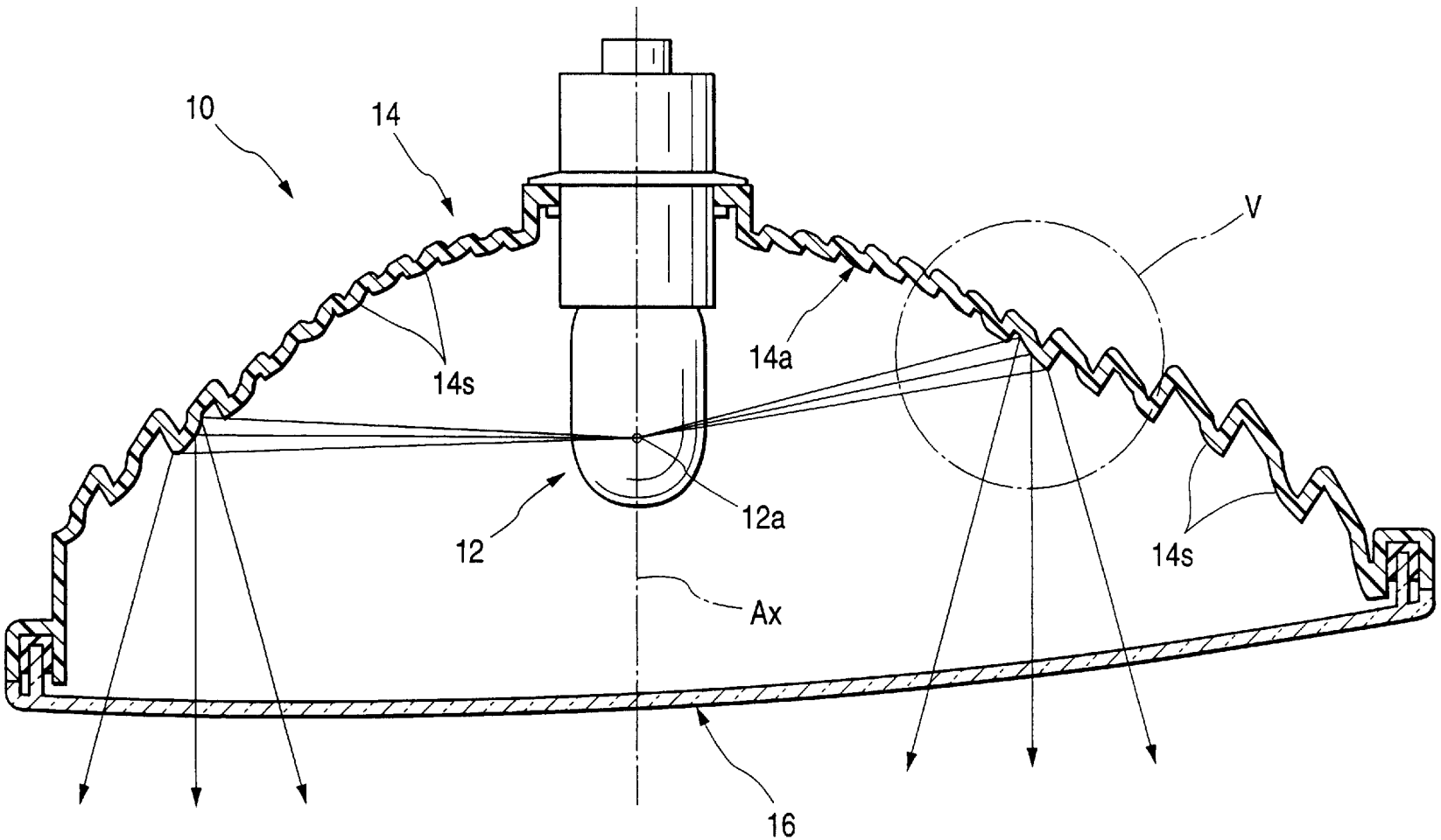
FIG. 2 shows a transverse section of the same vehicle lamp.

As shown in FIGS. 1 and 2, the vehicle lamp generally indicated by 10 is an automotive taillight and comprises a light source bulb 12 having a filament 12*a* (light source), a reflector 14 that not only supports the light source bulb 12 but also causes the light from it to be reflected in a forward direction, and a lens 16 having no refractive power that is provided ahead of the reflector 14.

The reflective surface 14*a* of the reflector 14 is composed of a plurality of diffusing reflector elements 14*s* formed on a free curved surface to be described later. The individual diffusing reflector elements 14*s* are respectively assigned to a plurality of sector segments S centering on the optical axis Ax of the reflector.

Figure 3:
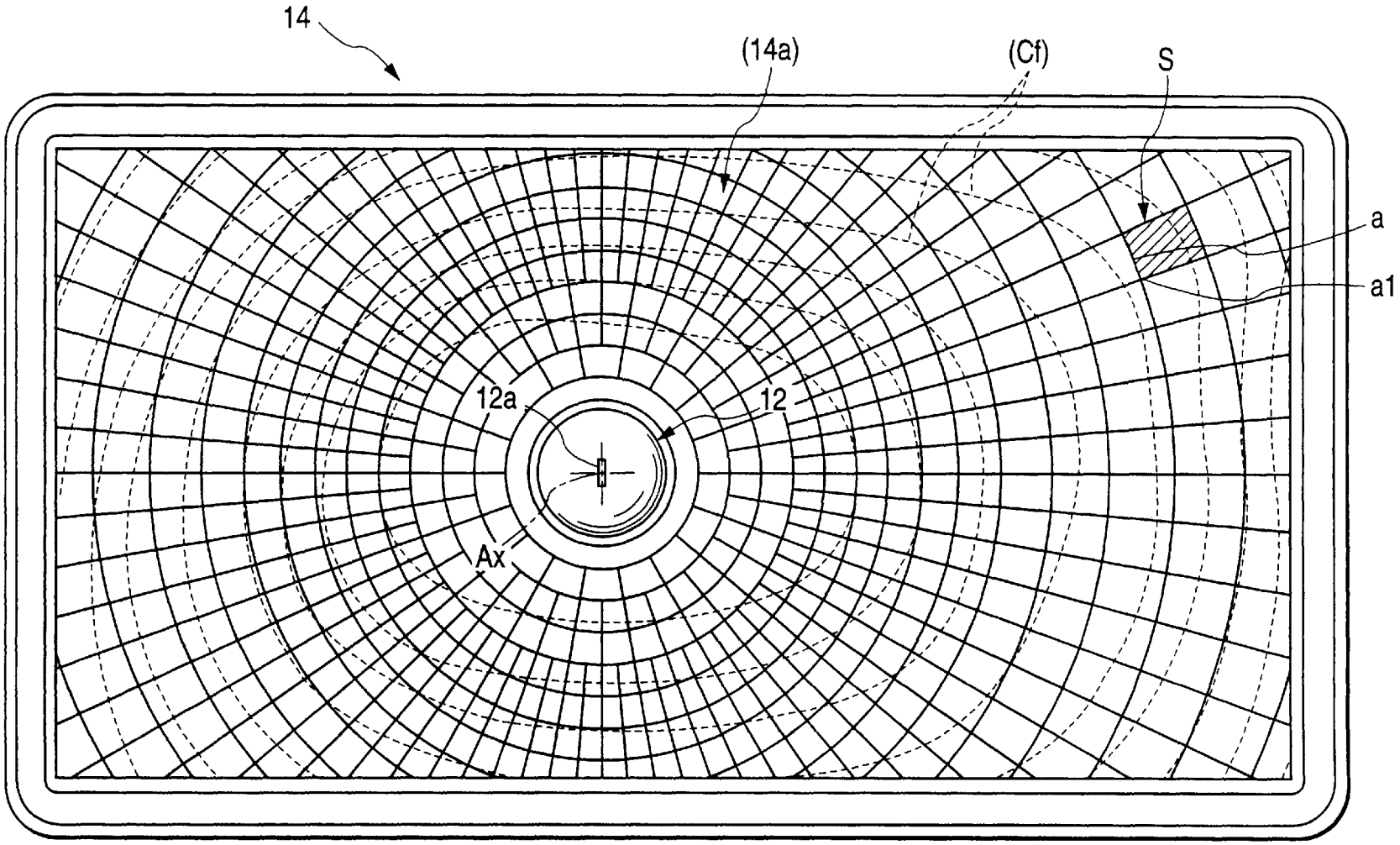
FIG. 3 shows a front view of the reflector of the same vehicle lamp, provided that diffusing reflector elements are yet to be formed on the reflective surface.

FIG. 3 is a front view of the reflector 14, provided that diffusing reflector elements 14*s* are yet to be formed on the reflective surface 14*a*. In FIG. 3, the closed curves indicated by dashed lines are the contour lines of the free curved surface Cf; and the straight lines extending radially and the circles (or arcs), both indicated by solid lines, are the boundary lines of the sector segments S. The free curved surface Cf is a curved surface that is set as a space that can be occupied by the reflector 14 under the limitations imposed by the car body such as its structure and external shape.

As FIG. 3 shows, the sector segments S are divided as either radially or concentrically about the optical axis Ax. It should be noted here that the circumferential angular pitch of the sector segments S in areas near the optical axis Ax is set as integral multiples of the pitch in other areas and this ensures that the width of the sector segments S will not be unduly small in the circumferential direction. The radial pitch of the sector segments S is constant in areas closer to the optical axis Ax but in areas closer to the outer periphery, greater pitches are taken by sector segments S as they depart from the optical axis Ax.

Figure 4:
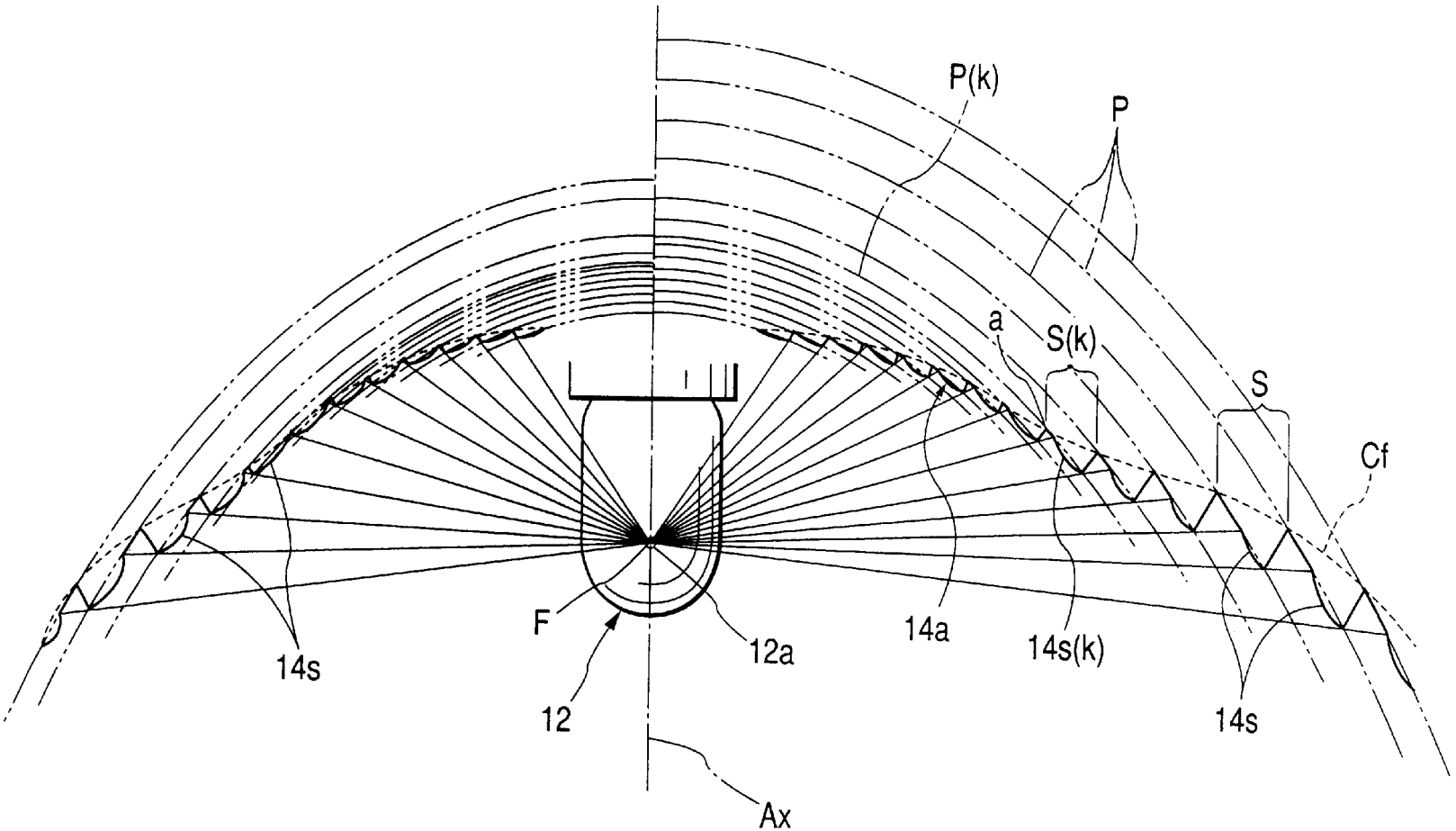
FIG. 4 shows a transverse section of the same reflector, provided that it shows only the reflective surface.

We now describe the method of setting the surface geometries of the individual diffusing reflector elements 14*s*. FIG. 4 is a transverse section of the reflector 14, provided that it shows only the reflective surface 14*a*. In FIG. 4, the curve indicated by a dashed line is the free curved surface Cf (or its section, to be more exact). As is clear from FIG. 4, each of the diffusing reflector elements 14*s* is formed with reference to a paraboloiod of revolution P(k) which, among a plurality of paraboloids of revolution P having different focal lengths that center on the optical axis Ax with a common focus F lying at a single point on said optical axis Ax, passes the edge of a side a closer to the optical Ax (to be more exact, one end point of the side as will be mentioned later) of a sector segment S(k) to which said diffusing reflector element 14*s*(k) is to be assigned on the free curved surface Cf.

If, as in the embodiment under consideration, the free curved surface Cf is a nearly planar surface that crosses the optical axis Ax at right angles, the focal lengths of the paraboloids of revolution P that compose the reference planes for the diffusing reflector elements 14*s* are set to have greater values for those sector segments S which are away from the optical axis Ax.

Figure 5:
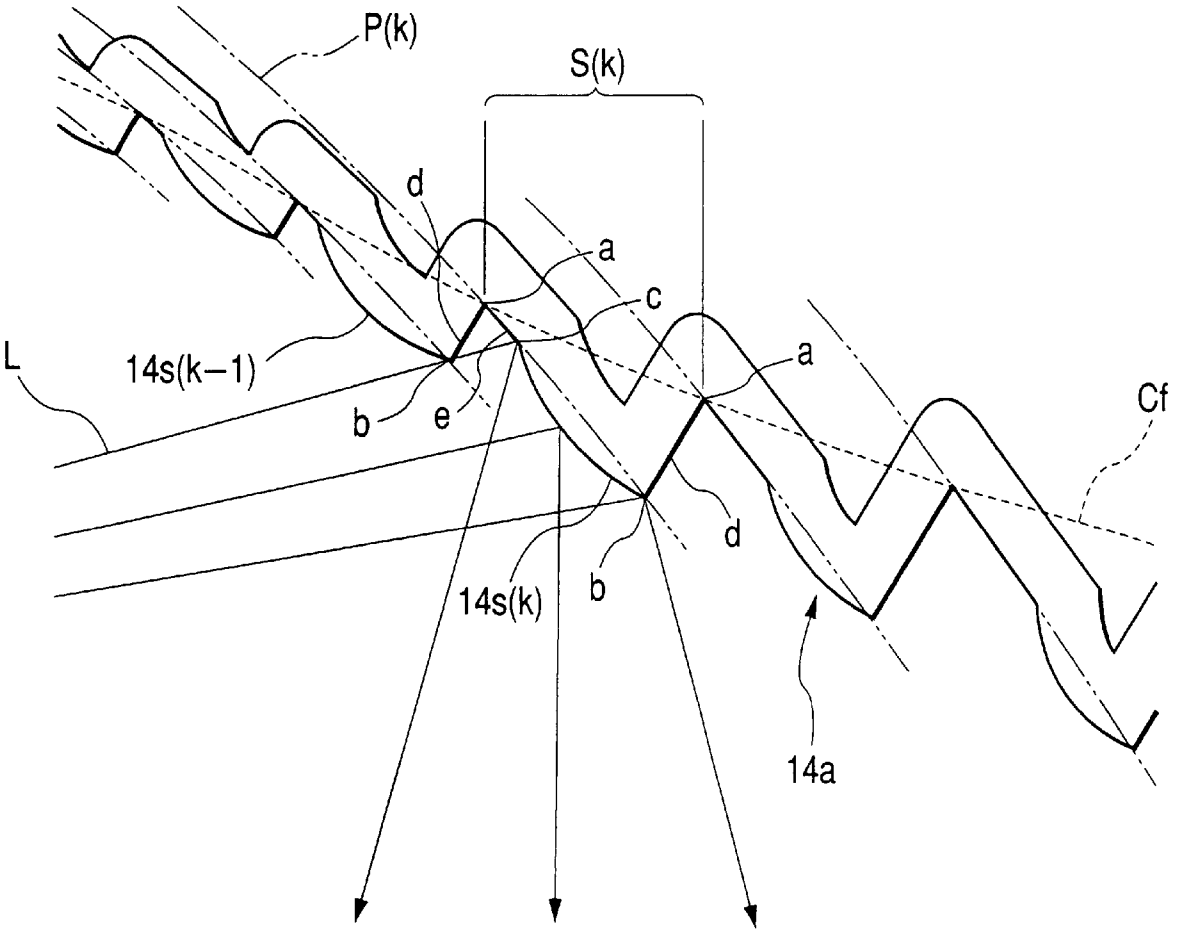
FIG. 5 shows details of area V in FIG. 2.

FIG. 5 shows details of area V in FIG. 2. As shown, a diffusing reflector element 14*s*(k) is assigned to an area that is away from the optical axis Ax and which extends from a curve c (a circumferentially extending arcuate line) along which a straight line L that passes through the edge of a side b away from the optical axis of a diffusing reflector element 14*s*(k−1) adjacent said diffusing reflector element 14*s*(k) in a direction toward the optical axis and the filament 12*a* of the light source bulb 12 (to be more exact, the center position of the filament 12*a*) intersects the reference plane P(k) for said diffusing reflector element 14*s*(k). The surface geometry of the diffusing reflector element 14*s*(k) is set as a convex curved surface having a curvature in the radial direction, so that the diffusing reflector element 14*s*(k) allows the light from the light source bulb 12 to be diffused and reflected in the radial direction around the optical axis Ax. The same construction is adopted for the surface geometries of the other diffusing reflector elements 14*s*.

Figure 6A:
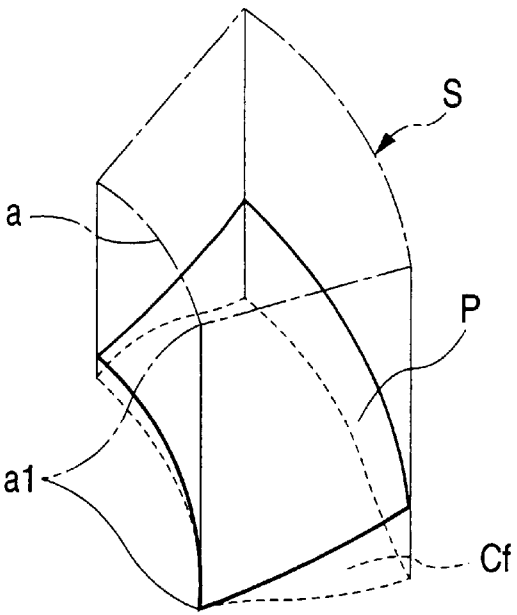
FIGS. 6(*a*), 6(*b*) and 6(*b*)' are perspective views providing a more exact description of how the surface geometries of diffusing reflector elements are set, with particular reference being made to a single sector segment.
Figure 6B:
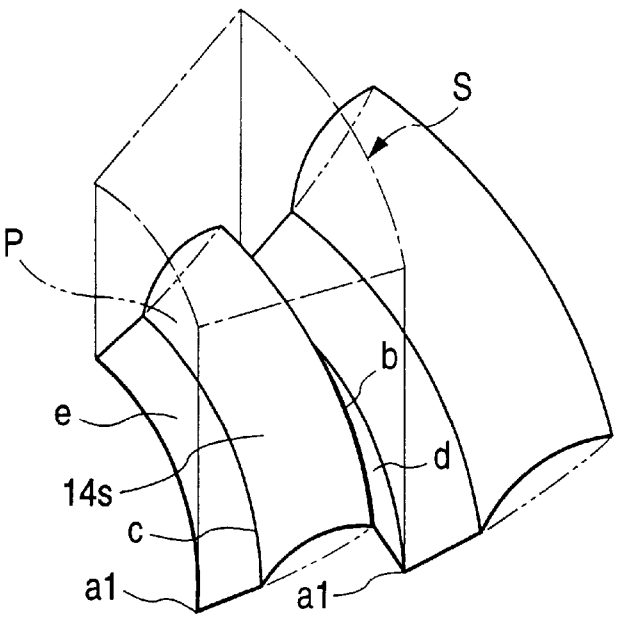
Figure 6B:
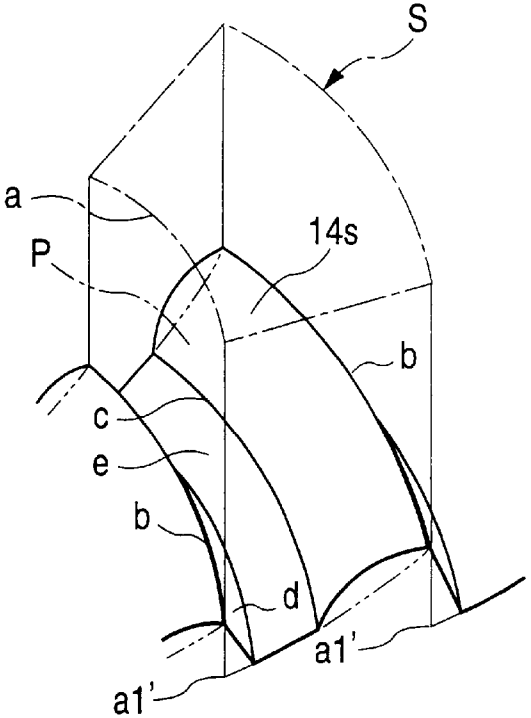
Figure 7:
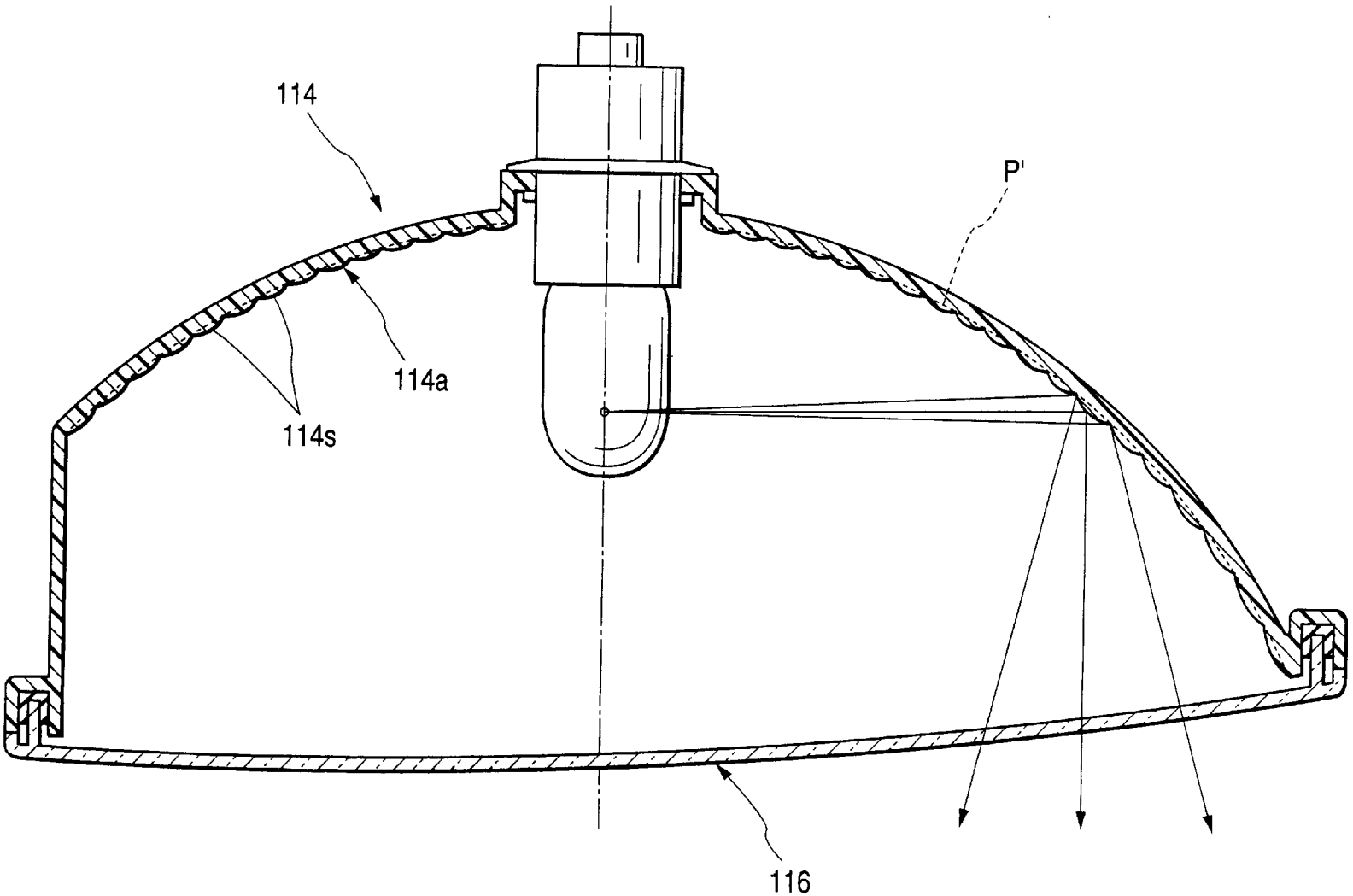
FIG. 7 shows a transverse section of a prior art vehicle lamp.
Figure 8:
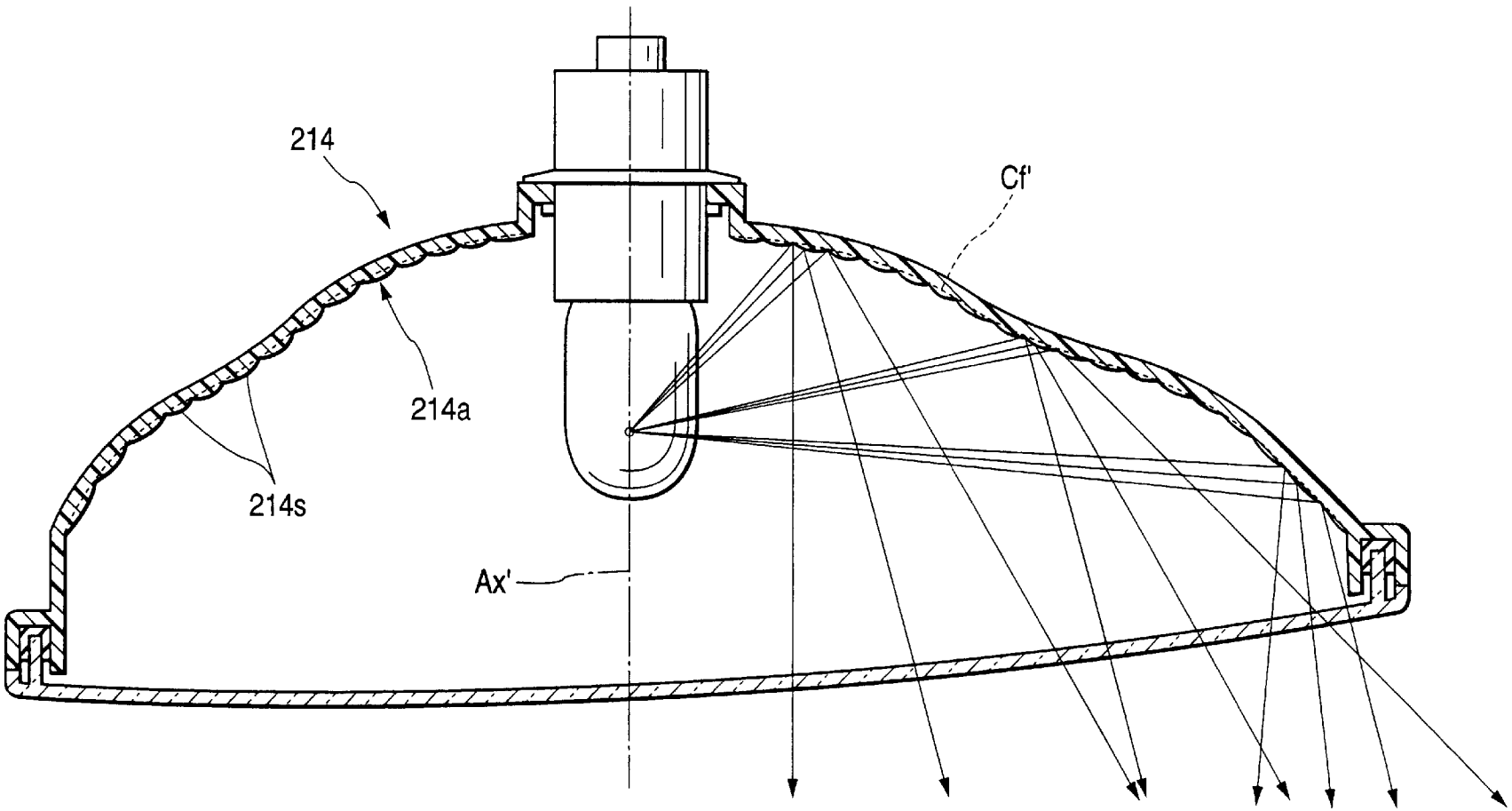
FIG. 8 shows a transverse section of another prior art vehicle lamp.

FIG. 6 is a set of perspective views for providing a more exact description of how the surface geometries of the diffusing reflector elements 14*s* are set, with particular reference being made to a single sector segment S. As shown in FIG. 6(*a*), the paraboloid of revolution P serving as a reference plane for each diffusing reflector element 14*s* is, to be exact, such that it passes one end point a1 of the edge of the side a of a sector segment S which is closer to the optical axis. The diffusing reflector element 14*s* is assigned to the thus determined paraboloid of revolution P in the manner shown in FIG. 6(*b*).

The beams of the diffusing reflected light from the individual diffusing reflector elements 14*s* combine to ensure that the reflective surface 14*a* taken as a whole will produce diffusing reflected light about the optical axis Ax. As a result, in spite of the use of the lens 16 having no refractive power, the reflector can provide the intended luminous intensity distribution for the taillight.

If the surface geometries of the diffusing reflector elements 14*s* are set in the manner described above, a step d that sharply descends in a direction away from the optical axis forms on the side of a diffusing reflector element 14*s* in each sector segment S that is away from the optical axis. The process of making a mold requires that the step d be formed at a specified angle with the optical axis Ax, so the edge of the side b of each diffusing reflector element 14*s* which is away from the optical axis is positioned to be a little closer to the optical axis Ax than the boundary line of the sector segment S which is away from the optical axis.

Further referring to each sector segment S, the area e which is located closer to the optical axis Ax than the curve c (i.e., the area where no diffusing reflector element 14*s* is formed) is a non-reflective area where none of the light from the light source is incident due to the step d of the diffusing reflector element 14*s* that is adjacent toward the optical axis Ax and, hence, the surface geometry of that area is set to be no different from that of the paraboloid of revolution P serving as a reference plane for the diffusing reflector element 14*s*.

As described above in detail, the reflective surface 14*a* of the reflector 14 in the identification lamp of the embodiment under consideration is composed of a plurality of diffusing reflector elements 14*s* formed on the free curved surface Cf. This increases the degree of freedom in the shape of the reflector 14 and even if only a limited space is available for installing the identification lamp, the reflective surface of the reflector 14 can be composed while ensuring a sufficient diameter for its opening.

Given this basic design, the individual diffusing reflector elements 14*s* are respectively assigned to a plurality of sector segments S centering on the optical axis Ax of the reflector 14 and the surface geometry of each diffusing reflector element 14*s* is set as a convex curved surface that is referenced to a paraboloid of revolution P which, among a plurality of paraboloids of revolution P having different focal lengths that center on the optical axis Ax with a common focus F lying at a single point on the optical axis Ax, passes through one end point a1 of the edge of the side a closer to the optical axis Ax of the sector segment S to which said diffusing reflector element 14*s* is to be assigned on the free curved surface Cf. As a result, the diffusing reflected light from each diffusing reflector element can be controlled in diffusion with reference to the optical axis Ax of the reflector 14 and the directivity of the diffusing illumination from the reflective surface 14*a* taken as a whole can be easily controlled. In addition, when the lighting device is lit up and viewed right from the front, the entire part of its reflective surface is visible and can be seen bright although in a discrete manner.

Thus, according to the embodiment under consideration, there is provided a vehicle lamp in which the reflective surface of the reflector is composed of a plurality of diffusing reflector elements formed on the free curved surface and which is characterized by ease in assuring the intended luminous intensity distribution for the lighting device while preventing from looking less attractive when it is lit up.

The embodiment under consideration offers the following additional advantage in the way the lighting device looks externally when it is lit up. If, as in the embodiment under consideration, a plurality of diffusing reflector elements 14*s* are formed stepwise on the free curved surface Cf, a difference in level or step d occurs between radially adjacent diffusing reflector elements 14*s*. In the embodiment, however, the individual diffusing reflector elements 14*s* are assigned respectively to the plurality of sector segments S centering on the optical axis Ax of the reflector 14 and, hence, no shades will be cast between circumferentially adjacent diffusing reflector elements 14*s* but shades are only cast between radially adjacent diffusing reflector elements 14*s*. The shades thus cast are generally shaped like arcuate bands centering on the optical axis Ax. In addition, the sector segments S are arranged concentrically, so they also cast circumferentially continuous shades. As a result, when the lighting device is lit up, the reflective surfaced 14*a* provides a striped pattern consisting of alternating concentric light and dark circles and none of the shades present will render the lighting device to look less attractive; on the contrary, the lighting device will look in a better and unique way.

In the embodiment under consideration, the radial widths of the individual sector segments S are so set that they increase as they depart from the optical axis Ax in an area closer to the outer periphery of the reflective surface 14*a* and, hence, the theory of linear perspective helps provide the reflector 14 with a greater feeling of depth than its actual depth dimension. It should be noted that the design of gradually changing the radial pitch of the sector segments S may be applied to the entire area of the reflective surface 14*a* and this helps provide an even greater feeling of depth.

Further in addition, in the embodiment under consideration, the focal lengths of the paraboloids of revolution P that serve as reference planes for the individual diffusing reflector elements 14*s* are set to have greater values for the diffusing reflector elements 14*s* assigned to sector segments that are increasingly distant from the optical axis Ax, and this helps reduce the thickness of the reflector 14.

In the case just described above, the area of each diffusing reflector element 14*s* that casts a shade due to the step d of the diffusing reflector element 14*s* which is adjacent toward the optical axis Ax becomes a non-reflective area. However, in the embodiment under consideration, each diffusing reflector element 14*s* is assigned to an area more remote from the optical axis than the curve c along which the straight line L passing through the edge of the side b away from the optical axis Ax of a diffusing reflector element 14*s* that is adjacent toward the optical axis Ax and the light source intersects the reference plane for said diffusing reflector element 14*s*; hence, the desired diffusing and reflecting angles can be assured for the individual diffusing reflector elements 14*s*, whereby the intended luminous intensity distribution can be positively provided for the lighting device.

The description of the foregoing embodiment has been limited to the case where the surface geometry of each diffusing reflector element 14*s* is set as a convex surface having a curvature in the radial direction; alternatively, said surface geometry may be set as a concave surface having a curvature in the radial direction. If desired, the surface geometry may be set as a surface having a curvature not only in the radial direction but also in the circumferential direction, or alternatively, it may be set as a curve having a curvature only in the circumferential direction.

In the foregoing embodiment, the surface geometry of each diffusing reflector element 14*s* is referenced to a paraboloid of revolution P that passes one end point al of the edge of the side a of a sector segment S which is closer to the optical axis. Needless to say, the sector segment S has four end points and either one of the end points other than a1 may be substituted.

The description of the foregoing embodiment assumes that the surface geometry of the non-reflective area e of each sector segment S which is located closer to the optical axis Ax than the curve c is set to be no different from that of the paraboloid of revolution P serving as a reference plane for the diffusing reflector element 14*s*. This is not the sole case of the invention and in view of the fact that none of the light from the light source is incident on the non-reflective area e, luminous intensity distribution is in no way compromised by setting the non-reflective area e to have any surface geometries.

In the foregoing embodiment, the diffusing reflector elements 14*s* are assigned to the respective sector segments S in such a way that step d is formed on the outer periphery of each sector segment S. If desired, the diffusing reflector elements 14*s* may be so assigned as to form step d on the inner periphery of each sector segment S [see FIG. 6(*b*)']. In this alternative case, the edge of the side a of each sector segment S which is closer to the optical axis Ax agrees with the edge of the side b away from the optical axis of a diffusing reflector element 14*s* that is formed in a sector segment S adjacent toward the optical axis Ax and one end point a1' of the edge of the side a (which serves as a reference for the paraboloid of revolution P) is set as an imaginary point. Even if this alternative method is adopted in assigning the diffusing reflector segments 14*s*, the result is the same as obtained in the foregoing embodiment.

The description of the foregoing embodiment concerns the case where the vehicle lamp is a taillight. This is not the sole case of the invention and the same construction as that of the foregoing embodiment may be adopted for other types of vehicle lamp such as a clearance lamp and a turn signal lamp to achieve the same result.

What is claimed is:

1. A vehicle lamp, comprising:

a light source; and a reflector which allows the light from said light source to be reflected in a forward direction and a reflective surface of the reflector is composed of a plurality of diffusing reflector elements formed on a free curved surface, wherein the surface geometry of each of said diffusing reflector elements is set on a specified curved surface with a reference plane of a paraboloid of revolution which is selected from a plural of a paraboloid of revolution with different focal lengths and centering around said optical axis with a common focus lying at a single point on said optical axis in such a way that said paraboloid of revolution passes a specified point of a sector segment to which said diffusing reflector element is to be assigned on said free curved surface.

2. The vehicle lamp according to claim 1, wherein the individual diffusing reflector elements are respectively assigned to a plurality of sector segments centering around the optical axis of said reflector.

3. The vehicle lamp according to claim 2, wherein the radial widths of said sector segments are set in such a way that they increase or decrease as they are leaving from said optical axis.

4. The vehicle lamp according to claim 1, wherein the focal lengths of paraboloids of revolution that serve as reference planes for said diffusing reflector elements are set to have greater values for the diffusing reflector elements assigned to segments which are leaving from said optical axis.

5. The vehicle lamp according to claim 2, wherein each of said diffusing reflector elements is assigned to an area more remote from the optical axis than a curve along which a straight line passing through the edge of a side away from the optical axis of a diffusing reflector element being adjacent toward the optical axis and said light source intersects the reference plane for said diffusing reflector element.

6. A vehicle lamp according to claim 1, wherein each of said plurality of diffusing reflector elements has a convex surface, said convex surface having a curvature in the radial direction.

7. A vehicle lamp according to claim 2, wherein said sector segment has a step that descends in a direction away from the optical axis.

8. A vehicle lamp according to claim 2, wherein said sector segment further comprises a non-reflective area.

* * * * *